United States Patent [19]

Matsubara et al.

[11] Patent Number: 4,940,644

[45] Date of Patent: Jul. 10, 1990

[54] TONER FOR DEVELOPMENT OF ELECTROSTATIC IMAGES AND IMAGE FORMING METHOD BY USE THEREOF

[75] Inventors: Akitoshi Matsubara; Satoru Ikeuchi; Kunio Akimoto; Yoshio Takizawa, all of Hachioji, Japan

[73] Assignee: Konishiroku Photo Industry Co., Ltd., Tokyo, Japan

[21] Appl. No.: 291,416

[22] Filed: Dec. 22, 1988

Related U.S. Application Data

[63] Continuation of Ser. No. 6,549, filed as PCT JP 86/00131 on Mar. 15, 1986, published as WO86/05602 on Sep. 25, 1986, abandoned.

[30] Foreign Application Priority Data

Mar. 15, 1985 [JP] Japan ..... 60-50340
Aug. 28, 1985 [JP] Japan ..... 60-187348
Aug. 28, 1985 [JP] Japan ..... 60-187350

[51] Int. Cl.[5] ..... G03G 9/10

[52] U.S. Cl. ..... 430/109; 430/904; 525/934

[58] Field of Search ..... 430/109, 904

[56] References Cited

U.S. PATENT DOCUMENTS 3,740,334 6/1973 Jacknow et al. ..... 430/109
4,002,570 1/1977 Lindblad ..... 430/110
4,012,363 3/1977 Bruning et al. ..... 427/185 X
4,145,300 3/1979 Hendriks ..... 430/109

*Primary Examiner*—J. David Welsh
*Attorney, Agent, or Firm*—Frishauf, Holtz, Goodman & Woodward

[57] ABSTRACT

This invention relates to a toner for development of electrostatic images to be used for development of electrostatic images formed in electrophotography, electrostatic printing, electrostatic recording, etc., and an image forming method by use thereof.

The toner of the present invention uses a resin constituted mainly of a copolymer comprising a crystalline polymer block and an amorphous polymer block chemically bound together, the cyrstalline polymer block has a specific melting point, the amorphous polymer block has a specific glass transition point, the moduli of the toner has a value with a specific range, and therefore according to the present invention, a toner excellent in durability can be provided, which is capable of fixing sufficiently even at a low temperature and yet also good in off-set resistance within such a temperature range, further having excellent anti-blocking characteristic, flowability, charging characteristic, anti-filming characteristic, cleaning property, thus being capable of forming good visible images stably.

19 Claims, No Drawings

TONER FOR DEVELOPMENT OF ELECTROSTATIC IMAGES AND IMAGE FORMING METHOD BY USE THEREOF

This application is a continuation of application Ser. No. 006,549, filed as PCT JP86/00131 on Mar. 15, 1986, published as WO86/05602 on Sep. 25, 1986, now abandoned.

TECHNICAL FIELD

This invention relates to a toner for development of an electrostatic image to be used in development of electrostatic images formed in electrophotography, electrostatic printing, electrostatic recording, etc., and an image forming method by use thereof.

BACKGROUND ART

For example, in electrophotography, an electrostatic image bearing member comprising a photoconductive photosensitive member is charged and exposed to light to form an electrostatic latent image thereon, then the electrostatic latent image is developed with a toner formed in fine particles by having colorants, etc. contained in a binder comprising a resin, and the toner image obtained is transferred onto a support such as a transfer paper, followed by fixing, to form a visible image.

Thus, in order to obtain a visible image, it is necessary to fix a toner image, and hot roller fixing system, which is high in thermal efficiency and capable of high speed fixing, has been widely employed in the prior art.

Whereas, in these days, for such demands as (a) suppresion of overheating of copying machine, (b) prevention of thermal deterioration of photosensitive member, (c) shortening of warm-up time required to elevation of temperature of hot roller to a temperature capable of fixing from the beginning of actuation of fixer, (d) feasibility of continuous copying for a large number of times by making lowering in temperature of hot roller due to absorption of the heat to transfer paper smaller, (e) enhanced thermal stability, etc., it has been strongly required to enable fixing treatment under the state where the temperature of the hot roller is made lower by lowering the consumed power of the heater for fixing. Accordingly, the toner is also required to be fixable well at a lower temperature.

Besides, a toner is required to be capable of existing stably as powder without agglomeration under the conditions during use or under the storage environment, namely excellent in anti-blocking property. Further, in the hot roller fixing system, which is preferred as the fixing method, since the off-set phenomenon, namely the phenomenon wherein a part of the toner constituting the image during fixing is transferred onto the hot roller and retransferred onto the next transfer paper delivered to stain the image, is liable to occur, it is required to impart to the toner a performance which can prevent generation of off-set phenomenon, namely off-set resistance.

For such reasons, in the prior art, there have been proposed a technique in which a polymer comprising at least one crystallizable polymer portion with a melting point of 45° to 150° C. and an amorphous polymer portion with a glass transition point of 0° C. or lower chemically linked together as is used as the binder resin constituting the toner, as disclosed in Japanese Unexamined Patent Publication No. 87032/1975, or a technique in which a thermoplastic polymer containing in its molecule a crystalline block with melting point of 50° to 70° C. and an amorphous block having a glass transition point higher by at least 10° C. than the melting point of the crystalline block, with the content of the crystalline block being 70 to 95 wt.%, is used as the binder resin constituting the toner, as disclosed in Japanese Unexamined Patent Publication No. 3446/1984.

Also, Japanese Unexamined Patent Publication No. 8549/1982 discloses a toner containing a graft copolymer comprising a crystalline trank polymer portion comprising at least one monomer selected from ethylene, propylene and vinyl acetate; an unsatureted polyester trank polymer portion; and a vinyl type branch polymer portion.

However, in the technique disclosed in the above Japanese Unexamined Patent Publication No. 87032/1975, the toner, which is constituted of a copolymer having a crystalline polymer portion which is soft at normal temperature and an amorphous polymer portion which is sticky and soft due to the glass transition point of 0° C. or lower chemically linked together, has the disadvantage that it may cause blocking phenomenon in a developing instrument, etc., even at normal temperature. Also, developing characteristic is bad due to poor triboelectric chargeability and flowability to give unclear images much in fog. Also, after a large number of copying, a soft toner will generate the filming phenomenon that the toner is attached on the carrier particles or the surface of the photosensitive member. Further, the toner becomes fused onto a cleaning member such as cleaning blade, etc., whereby the images become unclear with much fog and low density. Also, due to its softness, the toner is liable to be formed into a mass in a pulverizing machine during pulverization at normal temperature, thus having the disadvantages such that pulverization can be done with difficulty to give no toner with desired particle size to make the cost higher with poor production efficiency. Further, due to high stickiness, off-set phenomenon is liable to be generated on a hot roller fixer which is not coated with a large amount of oil.

On the other hand, in the technique disclosed in Japanese Unexamined Patent Publication No. 3446/1984, since an amorphous block having a high glass transition point of 100° C. or higher is used, a large amount as 70 to 95 wt.% of a crystalline block must be used as a method to satisfy meltability at a low temperature, whereby the properties of the soft crystalline block having plastic deformability at normal temperature are reflected on the toner. That is, due to its softness, triboelectric chargeability and flowability are bad to make developing characteristic bad, whereby unclear images with much fog are obtained. Also, after a large number of copies are made, the toner will generate the filming phenomenon that the toner is attached on the carrier particles or the surface of the photosensitive member, and also triboelectric chargeability becomes bad and the toner is further fused onto a cleaning member such as cleaning blade, etc., whereby the images become unclear with much fog and low density. Further, in a fixing method by heating within a short time with the use of a hot roller fixer not coated with a large amount of oil, the fixable temperature becomes higher due to the high glass transition point of the above amorphous block of 100° C., and also off-set phenomenon is liable to be generated due to much crystalline block which is 70 to 95 wt.%.

Further, the toner disclosed in Japanese Unexamined Patent Publication No. 8549/1982 is also bad in flowability, whereby no developer having toner uniformly dispersed in carrier can be formed and no sufficient triboelectric chargeability can be obtained to make developing characteristic poorer and generate image drop-off, thus giving unclear images. Further, in copying over a large number of times, due to bad flowability of the toner, the toner cannot be dispersed uniformly into the developer even when the toner may be supplemented, whereby the images become unclear.

The prior art has failed to provide a practical toner which avoids the disadvantages described above.

DISCLOSURE OF THE INVENTION

The present invention has been accomplished based on the situation as described above, and its first object is to provide a toner for development of electrostatic images which is low in fixing temperature, good in off-set resistance and broad in the range of fixable temperature.

A second object of the present invention is to provide a toner which does not generate off-set phenomenon even in a hot roller fixing system without coating of an oil.

A third object of the present invention is to provide a toner having good antiblocking property.

A fourth object of the present invention is to provide a toner which is good in flowability, stability of triboelectric charging and developing characteristic to give sharp images without fog.

A fifth object of the present invention is to provide a toner which does not generate filming on carrier particles, the surface of photosensitive member or cleaning member and is good in cleaning characteristic to give sharp images without fog.

A sixth object of the present invention is to provide a toner which is good in dispersibility of colorants to give images with high image density.

A seventh object of the present invention is to provide a toner which is good in filming resistance, cleaning characteristic, uniform dispersibility of the toner into a developer and developing characteristic even in a large number of uses, thereby giving sharp images of high image density without fog.

An eighth object of the present invention is to provide an image forming method by use of the above toner for development of electrostatic images.

The present inventors have studied intensively, and consequently found that the above objects can be accomplished by a toner for development of electrostatic images, which is constituted of at least a resin and a colorant, characterized in that the above resin is constituted mainly of a copolymer comprising a crystalline polymer block and an amorphous polymer block chemically bound together, the above crystalline polymer block has a melting point of 50° to 120° C., the above amorphous polymer block has a glass transition point of 50° to 100° C., and at least one point of the dynamic moduli at 70° to 140° C. of the above toner has a value of not smaller than $2\times10^3$ dyn/cm$^2$ and not greater than $1\times10^5$ dyn/cm$^2$.

In the toner for development electrostatic images of the present invention, the objects of the present invention can be accomplished only when the three conditions shown below are satisfied at the same time, namely:

(1) a copolymer comprising a crystalline polymer block and an amorphous polymer block chemically bound together is used;

(2) the crystalline polymer block has a specific melting point and the amorphous polymer block has a specific glass transition point;

(3) the modulus of the toner has a value within a specific range.

Here, "crystalline polymer block" means the polymer portion having a melting point, and "amorphous polymer block" means an amorphous polymer portion having no melting point.

Also, "melting point of crystalline polymer block" or "glass transition point of amorphous polymer block" means respectively the melting point or the glass transition point of the crystalline polymer block or the amorphous polymer block under the state which are not coupled with each other.

The present invention is described in detail below.

The resin constituting the toner of the present invention is constituted mainly of (1) a copolymer comprising a crystalline polymer block and amorphous polymer block chemically bound together, (2) the melting point Tm of the above crystalline polymer block being 50° to 120° C., preferably 50° to 100° C., and the glass transition point Tg of the above amorphous polymer being 50° to 100° C., preferably 50° to 85° C., (3) at least one point of the dynamic moduli G' at 70° to 140° C. of the toner containing the above copolymer having a value of not smaller than $2\times10^3$ dyn/cm$^2$ and not greater than $1\times10^5$ dyn/cm$^2$.

A toner not satisfying the above three conditions will be worsened in anti-blocking property, off-set resistance, flowability, low temperature fixability, and also fixable range will be narrowed.

To describe in more detail, if the melting point of the above crystalline polymer block is lower than 50° C., anti-blocking property of the toner obtained becomes poor, while with a melting point exceeding 120° C., the melt flowability at low temperature will be lowered to make fixability bad. If the glass transition point of the above amorphous polymer block is lower than 50° C., flowability, off-set resistance, pulverizability, anti-blocking property, filming resistance and durability of the toner obtained will become poor, while its low temperature fixing characteristic becomes bad with a glass transition point over 100° C.

Also, the molecular weight of the above crystalline polymer block should preferably be 1,000 to 20,000 in terms of number average molecular weight and 2,000 to 100,000 in terms of weight average molecular weight. When the molecular weight is within this range, off-set resistance and pulverization efficiency of the toner can be further improved. The molecular weight of the above amorphous polymer block should preferably be 1,000 to 50,000 in terms of number average molecular weight and 5,000 to 150,000 in terms of weight average molecular weight. When the molecular weight is within this range, anti-blocking property, pulverization efficiency, low temperature fixing characteristic of the toner can be further improved.

The above crystalline polymer block and the amorphous polymer block may be either compatible or non-compatible with each other, but preferably non-compatible from the view point of pulverizability, anti-blocking property, etc., of the toner. Here, "non-compatible" refers to absence of the property of sufficient dispersion of the both polymers through the same or similar chemical structures of both or the action of functional groups, exhibiting a difference in solubility parameter of, for example, 0.5 or greater in terms of the S.P. value according to the method of Fedors (R.F. Fedors, Polym. Eng. Sci., 14, (2) 147 (1974)).

The copolymer to be used in the present invention is a copolymer having block portions having different physical properties as described above, and comprises at least one crystalline polymer block and at least one amorphous polymer block chemically linked to each other. Such a copolymer may be a block copolymer or a graft copolymer having block portions grafted at the side chain other than the main chain, or alternatively it may be a straight chain or may have branches. Among them, a block copolymer is particularly preferred.

The molecular weight of the above copolymer may differ depending on the composition/proportion of the crystalline polymer block and amorphous polymer block and other factors and cannot be specified indiscriminately, but approximately its number average molecular weight Mn may be 1,000 or more and its weight average molecular weight Mw 5,000 or more, particularly preferably Mn being 1,000 to 30,000 and Mw 5,000 to 300,000 from the viewpoint of off-set resistance, durability, pulverization efficiency.

The softening point Tsp of the above copolymer may be different depending on the kind of the polymer employed and is not particular limited, but it is within the range of from 70° to 150° C., more preferably from 90° to 140° C. When the softening point is within this range, the toner obtained becomes further better in off-set resistance, anti-filming property and low temperature fixability.

Also, the glass transition point of the above copolymer is correlated with the glass transition point of the amorphous polymer block, and the glass transition point of the copolymer is substantially equal to that of the amorphous polymer block when the crystalline polymer block and the amorphous polymer block are non-compatible with each other.

The toner of the present invention contains a specific copolymer as described above as the resin, and contains at least 50 wt.% of the above copolymer.

As for the dynamic moduli G' of the toner obtained, at least one point thereof in the temperature range from 70° to 140° C. takes a value not smaller than $2\times10^3$ dyn/cm$^2$ and not greater than $1\times10^5$ dyn/cm$^2$ as mentioned above, and its dynamic viscosity $\eta'$ is not particularly limited, but at least one point in the temperature range from 70° to 140° C. should preferably be $1\times10^6$ poise or less, above all $1\times10^5$ poise or less from the viewpoint of fixable temperature range.

The proportion of the crystalline polymer block constituting the above copolymer should preferably be 1 to 60 wt.%, more preferably 5 to 50 wt.%, most preferably 5 to 40 wt.% based on the copolymer. With a proportion less than 1 wt.%, the effect on the low temperature fixing characteristic is small, while flowability, development characteristic, anti-filming property, off-set resistance and durability of the toner tend to be impaired if it exceeds 60 wt.%.

As the crystalline polymer block which can be used in the present invention, any crystalline polymer may be available and its structure is not particularly limited, but there may be employed polyesters, polyolefins, polyvinyl esters, polyethers, etc. Specific example are enumerated below.

Polyesters:

polyethylene sebacate, polyethylene adipate, polyethylene suberate, polyethylene succinate, polyethylene-p-(carbophenoxy)undecaate, polyhexamethylene oxalate, polyhexamethylene sebacate, polyhexamethylene decanedioate, polyoctamethylene dodecanedioate, polynonamethylene azelate, polydecamethylene adipate, polydecamethylene azelate, polydecamethylene oxalate, polydecamethylene sebacate, polydecamethylene succinate, polydecamethylene dodecadioate, polydecamethylene octadecanedioate, polytetramethylene sebacate, polytrimethylene dodecanedioate, polytrimethylene octadecanedioate, polytrimethylene oxalate, polyhexamethylene-decamethylene-sebacate, polyoxydecamethylene-2-methyl-l,3-propane-dodecanedioate and others.

Polyolefins:

poly-1-butene, poly-3-methylbutene, poly-1-hexadecene, poly-1-octadecene, poly-1-pentene, poly-4-methylpentene and others.

Polyvinyl esters:

polyallyl acrylate, polyisobutyl acrylate, polydecyl acrylate, polyoctadecyl acrylate, polydodecyl acrylate and others.

Polyethers:

polybutyl vinyl ether, polyisobutyl vinyl ether, polyisopropyl vinyl ether, polyethyl vinyl ether, poly-2-methoxyethyl vinyl ether and others.

Among them, polyesters are particularly preferred, and polyalkylene polyesters are further preferred. These polyesters, above all polyalkylene polyesters can be used to give the effect in low temperature fixing characteristic of the toner and improve flowability, probably for the reason as mentioned below. That is, in condensation system resins such as polyester resin, a low molecular weight resin can be obtained with ease, and further the "flow" onto a supporting member such as transfer paper, etc., is better when melted as compared with a vinyl type resin such as styrene, etc., whereby sufficient fixing can be effected at lower temperature than the toner containing a vinyl type resin having a substantially equal softening point.

The amorphous polymer block to be used in the present invention is not particularly limited, provided that it is an amorphous polymer having no specific crystalline structure, but it can be selected from vinyl polymers, polyester polymers and others. Among them, polyester polymers are particularly preferred, more preferably aromatic polyester polymers. By use of an aromatic polyester polymer, triboelectric chargeability is good, exhibiting stable chargeability even in a large number of uses, and also because it is rigid, flowability and durability of the toner are good, thus giving sharp images. This is because of the same reason for using preferably a polyester in the crystalline polymer portion. As such an aromatic polyester, at least one of the polyvalent carboxylic acid or polyvalent alcohol may be an aromatic monomer. As the monomer for such an amorphous polymer, examples of the alcohol to be used may include diols such as ethylene glycol, diethylene glycol, triethylene glycol, 1,2-propylene glycol, 1,3-propylene glycol, 1,4-butanediol, neopentyl glycol, 1,4-butenediol and the like; 1,4-bis(hydroxymethyl)cyclohexane, and bisphenol A, hydrogenated bisphenol A, etherated bisphenol A such as polyoxyethylenated bisphenol A, polyoxypropylenated bisphenol A, etc., and other divalent alcohol monomers.

Examples of the carboxylic acid may include maleic acid, fumaric acid, mesaconic, citraconic acid, itaconic acid, glutaconic acid, phthalic acid, isophthalic acid, terephthalic acid, cyclohexane dicarboxylic acid, succinic acid, adipic acid, sebacic acid, malonic acid, anhydrides of these acids, dimers of lower alkyl esters and linolenic acid, and other divalent organic acid monomers.

As the polyester polymer to be used as the amorphous polymer block in the present invention, not only the polymers of only bifunctional monomers as mentioned above, but also polymers containing a component by use of a trifunctional or more polyfunctional monomer may be also included as preferable ones. Examples of trivalent or higher polyhydric alcohol monomers which are such polyfunctional monomers may include sorbitol, 1,2,3,6-hexanetetrol, 1,4-sorbitane, pentaerythritol, dipentaerythritol, tripentaerythritol, sucrose, 1,2,4-butane triol, 1,2,5-pentane triol, glycerol, 2-methyl propane triol, 2-methyl-l,2,4-butne triol, trimethylol ethane, trimethylol propane, 1,3,5-trihydroxymethyl benzene and others.

Also, trivalent or higher polyvalent carboxylic acid monomers may be exemplified by 1,2,4-benzene tricarboxylic acid, 1,2,5-benzene tricarboxylic acid, 1,2,4-cyclohexane tricarboxylic acid, 2,5,7-naphthalene tricarboxylic acid, 1,2,4-naphthalene tricarboxylic acid, 1,2,4-butane tricarboxylic acid, 1,2,5-hexane tricarboxylic acid, 1,3-dicarboxy-2-methylcarboxypropene, 1,3-dicarboxy-2-methyl-2-methylenecarboxypropane, tetra(methylenecarboxy)methane, 1,2,7,8-octane tetracarboxylic acid, enpole trimer acid, acid anhydrides of these and others.

Specific examples to be used as the amorphous polymer portion may include the following.

(1)

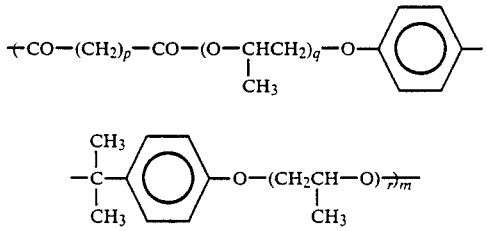

(e.g. p = 8, q = 1, r = 1, m = 20 )

(2)

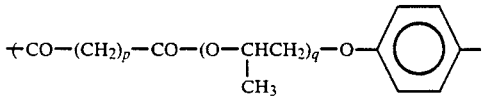

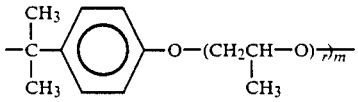

(e.g. p = 2, q = 1, r = 1, m = 15 )

(3)

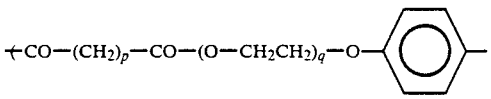

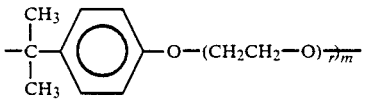

(e.g. p = 4, q = 1, r = 1, m = 30)

-continued (4)

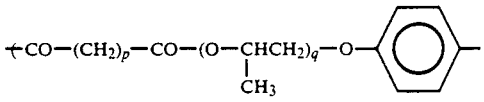

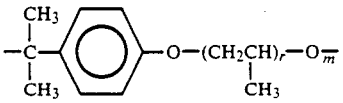

(e.g. p = 6, q = 3, r = 3, m = 25 )

(5)

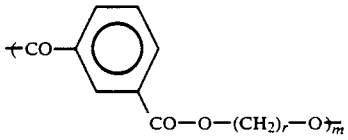

(e.g. r = 3, m = 5)

(6)

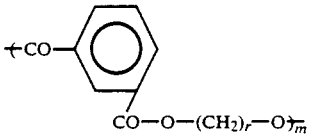

(e.g. r = 2, m = 35)

(7)

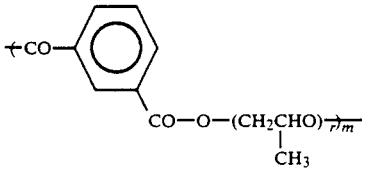

(e.g. r = 1, m = 41)

(8)

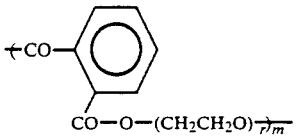

(e.g. r = 2, m = 37)

(9)

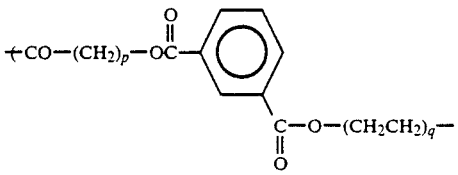

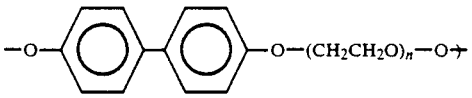

In the present invention, the melting point Tm of the crystalline polymer block, the glass transition point Tg of the amorphous polymer block, the dynamic moduli G' and the dynamic viscosity $\eta'$ of the toner of the present invention can be measured as follows.

Measurement of melting point Tm of crystalline polymer block:

Following differential scanning calorimetry (DSC), it can be measured by use of, for example, "DSC-20" (manufactured by Seiko Denshi Kogyo Co.), and the melting peak value obtained under the measuring condition of heating 10 mg of a sample at a constant temperature elevation rate (10° C./min) is defined as the melting point Tm.

Measurement of glass transition point Tg of amorphous polymer block:

Following differential scanning calorimetry (DSC), it can be measured by use of, for example, "DSC-20" (manufactured by Seiko Denshi Kogyo Co.) specifically by heating 10 mg of a sample at a constant temperature elevation rate (10° C./min), and the glass transition point Tg is obtained from the crossing point between the base line and the slanted line of heat absorption peak.

Measurement of dynamic moduli G' and dynamic viscosity $\eta'$ of toner:

For example, they can be measured by "Shimazu Rheometer RM-1" (manufactured by Shimazu Seisakusho Co.), specifically by melting a sample at a constant temperature and applying a sign wave vibration on the sample under molten state, and the dynamic moduli G' and the dynamic viscosity $\eta'$ are obtained from the amplitude ratio and the phase difference of torsion.

Measurement of softening point of copolymer:

The softening point Tsp in the present invention is measured by use of a high-level type flow tester (manufactured by Shimazu Seisakusho Co.) under the measuring conditions of a load of 20 kg/cm$^2$, a nozzle diameter of 1 mm, a nozzle length of 1 mm, preheating at 50° C. for 10 minutes, a temperature elevation rate of 6° C./min and a sample amount of 1 cm$^3$ (weight represented by genuine specific gravity$\times$1 cm$^3$) in the recorded chart, when the height of the S curve in the curve of plunger drop of flow tester-temperature (softening flow curve) is defined as h, the temperature at h/2 is measured.

Measurement of weight average molecular weight and number average molecular weight:

The values of the weight average molecular weight Mw and number average molecular weight Mn in the present invention can be determined according to various methods and may differ slightly depending on the measuring method, but they are determined according to the following measuring method in the present invention.

That is, according gel permeation chromatography (GPC), weight average molecular weight Mw and number average molecular weight Mn are measured under the conditions as specified below. At a temperature of 40° C., a solvent (tetrahydrofuran) is flowed at a rate of 1.2 ml per minute and 3 mg as the sample weight of a tetrahydrofuran sample solution at a concentration of 0.2 g/20 ml is injected to carry out measurement. In measuring the molecular weight of a sample, the measuring conditions are selected so that the molecular weight possessed by said sample is included within the range where the logarithmic of the molecular weights of the calibration curve prepared from several kinds of monodispersed polystyrene standard samples and the count number form a straight line.

In this connection, reliability of the measurement result can be confirmed that the NBS706 polystyrene standard sample as measured under the conditions as described above has the following molecular weights weight average molecular weight $Mw=28.8\times10^4$ number average molecular weight $Mn=13.7\times10^4$.

As the column of GPC to be used, any column may be employed which satisfies the above conditions. More specifically, for example, TSK-GEL, GMH (produced by Toyo Soda Co.), etc., can be used.

The solvent and the measurement temperature are not limited to the conditions as described above but they can be altered to appropriate conditions.

For obtaining a copolymer comprising the above crystalline polymer block and the amorphous polymer block chemically linked together, for example, they can be directly bonded in a head-tail fashion through the coupling reaction between the terminal functional groups existing in the respective polymers. Alternatively, the terminal functional groups of the respective polymers can be bonded with a bifunctional coupling agent. For example, they can be bonded with a urethane bond formed by the reaction of the polymers having hydroxyl groups as the terminal groups with diisocyanate or the ester bond formed by the reaction of the polymers having hydroxyl groups as the terminal groups and a dicarboxylic acid or the reaction of the polymers having carboxyl groups as the terminal groups and a glycol or other bonds formed by the reaction of polymers having hydroxy groups as the terminal groups and phosgen, dichlorodimethyl silane.

Specific examples of the above coupling agent may include bifunctional isocyanates such as hexamethylene diisocyanate, diphenylmethane diisocyanate, tolylene diisocyanate, tolidine diisocyanate, naphthylene diisocyanate, isophorone diisocyanate, xylylene diisocyanate and the like; bifunctional amines such as ethylenediamine, hexametylenediamine, phenylenediamine and the like; bifunctional carboxylic acids such as oxalic acid, succinic acid, adipic acid, sebacic acid, terephthalic acid, isophthalic acid and the like; bifunctional alcohols such as ethyleneglycol, propyleneglycol, butanediol, pentanediol, hexanediol, cyclohexanedimethanol, p-xylyleneglycol and the like; bifunctional acid chlorides such as terephthalic acid chloride, isophthalic acid chloride, adipic acid chloride, sebacic acid chloride and the like; other bifunctional coupling agents such as diisothiocyanate, bisketene, biscarbodiimide and others.

The amount of the coupling agent used may be at a proportion of 1 to 10 wt.%, preferably 2 to 7 wt.% based on the total weight of the above crystalline polymer and the amorphous polymer. If it exceeds 10 wt.%, the copolymer has too high a molecular weight, whereby the softening point becomes too high and fixing characteristic is impaired. In the case of an amount less than 1 wt.%, the molecular weight is so small that off-set resistance, anti-filming property and durability tend to be impaired.

The copolymer of the present invention can be also obtained according to the following method. That is, first a crystalline polymer is synthesized according to a conventional method and then a monomer required for formation of an amorphous polymer is added and the amorphous polymer is elongated from the terminal end of the crystalline polymer to synthesize the above copolymer. On the contrary, it is also possible to synthesize the above copolymer by elongating a crystalline polymer from the terminal end of an amorphous polymer.

The toner for development of electrostatic images of the present invention comprises a colorant contained in the resin comprising the specific copolymer as described above, and it may further contain a magnetic material, characteristic improving agents in the resin, if necessary. Examples of the colorant may include carbon black, Nigrosine dye (C.I.No. 50415B), Aniline Blue (C.I.No. 50405), Carcooil Blue (C.I.No. Azoec Blue 3), Chrome Yellow (C.I.No. 14090), Ultramarine Blue (C.I.No. 77103), Du Pont Oil Red (C.I.No. 26105), Quinoline Yellow (C.I.No. 47005), Methylene Blue chloride (C.I.No. 52015), Phthalocyanine Blue (C.I.No. 74160), Marachite Green oxalate (C.I.No. 42000), Lamp Black (C.I.No. 77266), Rose Bengal (C.I.No. 45435), these mixtures and others. These colorants are required to be contained at a proportion enough to form a visible image with a sufficient density, ordinarily in amounts of about 1 to 20 parts by weight per 100 parts by weight of the resin.

As the above magnetic material, there may be included metals or alloys exhibiting ferromagnetic property such as iron, cobalt, nickel, etc., typically ferrite, magnetite or compounds containing these elements, or alloys containing no ferromagnetic element but which will exhibit ferromagnetic property by application with appropriate heat treatment such as alloys of the kind called Whisler alloy containing manganese and copper such as manganese-copper-aluminum, manganese-copper-tin, or chromium dioxide and others. These magnetic materials are dispersed uniformly into the resin in the form of fine powder with an average particle size of 0.1 to 1 $\mu$. And its content is 20 to 70 parts by weight, preferably 40 to 70 parts by weight per 100 parts by weight of the toner.

The above mentioned characteristic improvers may include fixability enhancers, charge controllers and others.

As the fixability enhancer, for example, polyolefins, fatty acid metal salts, fatty acid esters and fatty acid ester type waxes, partially saponified fatty acid esters, higher fatty acids, higher alcohols, fluid or solid paraffin waxes, polyamide type waxes polyhydric alcohol esters, silicon varnish, aliphatic fluorocarbons, etc., can be used. In particular, waxes having softening points (ring and ball method JIS K2531) of 60° to 150° C. are preferred.

As the charge controller, those which have been known in the prior art can be used, for example, nigrosine type dyes, metal containing dyes, etc.

Further, the toner of the present invention should be preferably used with inorganic fine particles of a flowabilty enhancer, etc., mixed therein.

The above inorganic fine particles to be used in the present invention are particles having a primary particle size of 5 m$\mu$ to 2 $\mu$, preferably 5 m$\mu$ to 500 m$\mu$. Also, the specific surface area according to the BET method should preferably be 20 to 500 $m^2/g$. The proportion to be mixed into the toner is 0.01 to 5 wt.%, preferably 0.01 to 2.0 wt.%. Examples of such inorganic fine powder may include silica fine powder, alumina, titanium oxide, barium titanate, magnesium titanate, calcium titanate, strontium titanate, zinc oxide, silicious sand, clay, mica, wollastonite, diatomaceous earth, chromium oxide, cerium oxide, lead iron oxide, antimony trioxide, magnesium oxide, zirconium oxide, barium salfate, barium carbonate, calcium carbonate, silicon carbide, silicon nitride, etc., particularly preferably silica fine powder.

The silica fine powder as herein mentioned refers to fine powder having Si-O-Si bonds, including either one produced according to the dry process and the wet process. Also, other than anhydrous silicon oxide, either one of aluminum silicate, sodium silicate, pottasium silicate, magnesium silicate, zinc silicate, etc., containing 85 wt.% or more of $SiO_2$ is preferred.

Specific examples of these silica fine powders include various commercially available silicas, but those having hydrophilic groups on the surface are preferred, as exemplified by AEROSIL R-972, R-974, R-805, R-812 (all manufactured by Aerosil Co.), Taranox 500 (manufactured by Tarco Co.), etc. Otherwise, silica fine powders treated with silane coupling agent, titanium coupling agent, silicon oil, silicon oil having amines in the side chain, etc., can be used.

Referring now to a preferable example of the process for preparation of the toner of the present invention, first a material resin or a mixture containing toner components such as colorant added thereto if necessary is melted and kneaded through, for example, an extruder and after cooling finely pulverized by means of a jet mill, etc., followed by classification to obtain a toner with desired particle size. Alternatively, the melted and kneaded product through an extruder can be atomized or dispersed into a liquid under the molten state by a spray drier, etc., to obtain a toner with desired particle size.

As the image forming method of the present invention, a developer is prepared by use of the specific toner as described above, formation and development of electrostatic images are performed by means of a conventinal electrophotographic copying machine by use thereof, the toner image obtained is electrostatically transferred onto a transfer paper, followed by fixing by means of a hot roller fixer in which the hot roller temperature is set at a constant temperature to form a copied image.

The image forming method of the present invention may be used particularly preferably in carrying out fixing in which the contact time between the toner on transfer paper and the hot roller is within 1 second, particularly within 0.5 second.

BEST MODE FOR PRACTICING THE INVENTION

Example 1

By coupling 30 parts by weight of a crystalline polymer A shown below in Table 1 and 70 parts by weight of an amorphous polymer a shown below in Table 2 with 4.0% by weight of hexamethylene diisocyanate, a copolymer 1 shown below in Table 3 was obtained.

A mixture of 100 parts by weight of the copolymer 1, 10 parts by weight of a carbon black "Mogal-L" (produced by Cabot Co.), 3 parts by weight of a polypropylen "Biscol 660P" (produced by Sanyo Kasei Kogyo Co.), 2 parts by weight of "Wax-E" (produced by Hoechst Co.) and 2 parts by weight of a charge controller "Bontron-E-81" (produced by Orient Kagaku Co.) was kneaded on hot rolls. After cooling, the mixture was coarsely pulverized and further finely pulverized by a ultra-sonic jet mill, followed by classification by a wind force classifing machine to obtain colored fine particles.

By mixing 100 parts by weight of the colored fine particles with 0.8 parts by weight of hydrophobic silica fine powder "AEROSIL R-972" (produced by Aerosil Co.) by a V-type mixer to obtain toner 1 of the present invention with a volume average particle size of 11.0 μm.

The crystalline polymers and the amorphous polymers used for preparation of the copolymers and their weight part ratios, the number average molecular weights Mn and weight average molecular weight Mw of the copolymers obtained are shown in Table 3. In the Table, the crystalline polymers shown by A-F, their melting points Tm, weight average molecular weights Mw, number average molecular weights Mn and solubility parameters (S.P. value) are as shown in Table 1, and the amorphous polymers shown by a–f, their glass transition points, weight average molecular weights Mw, number average molecular weights Mn and solubility parameters (S.P. value) are as shown in Table 2.

Also, the dynamic moduli G', the dynamic viscosity η', etc., of the toners obtained are as shown in Table 4.

TABLE 1

| Crystalline polymer | m.p. Tm °C. | Weight average molecular weight Mw | Number average molecular weight Mn | Solubility parameter (S.P. value) (cal/cm$^3$)$^{1/2}$ |
|---|---|---|---|---|
| A Polyhexamethylene sebacate | 65 | 14000 | 4600 | 10.2 |
| B Polydecamethylene adipate | 78 | 12000 | 3800 | 10.2 |
| C Polyethylene succinate | 95 | 8900 | 3100 | 12.5 |
| D Polyethylene sebacate | 72 | 10400 | 3300 | 10.7 |
| E Polyethylene adipate | 47 | 7600 | 2900 | 10.8 |
| F Polypentamethylene terephthalate | 134 | 9100 | 3200 | 11.2 |

TABLE 2

| Amorphous polymer | Glass transition point Tg °C. | Weight average molecular weight Mw | Number average molecular weight Mn | Solubility parameter (S.P. value) (cal/cm$^3$)$^{1/2}$ |
|---|---|---|---|---|
| a Polypropylene isophthalate | 54.5 | 13400 | 4500 | 11.2 |
| b Poly-(2,2'-dimethyl)-1,3-propylene-isphthalate | 57.0 | 10800 | 3600 | 11.1 |
| c Polyoxypropylene bisphenol A-fumarate · terephthalate (molar ratio of 2:1:1) | 67 | 13300 | 4600 | 9.8 |
| d Polyoxypropylene bisphenol A-sebacate | 0 | 4900 | 1800 | 10.4 |
| e Polyester obtained from equimolar mixture of isophthalic acid, propylene glycol and cyclohexane dimethanol | 62.5 | 10000 | 3800 | 12.5 |
| F Polyester obtained from terephthalic acid and polyoxypropylene-,2)-2,2-bis(4-hydroxyphenyl)-propane | 65.0 | 18400 | 6200 | 10.8 |

TABLE 3

| | Copolymer | Crystalline polymer and its weight part ratio | | Amorphous polymer and its weight part ratio | | Weight average molecular weight Mw | Number average molecular weight Mn |
|---|---|---|---|---|---|---|---|
| Example 1 | Copolymer-1 | A | 30 wt. parts | a | 70 wt. parts | 29200 | 5800 |
| Example 2 | Copolymer-2 | B | 20 wt. parts | b | 80 wt. parts | 30800 | 6300 |
| Example 3 | Copolymer-3 | C | 30 wt. parts | c | 70 wt. parts | 43500 | 7200 |
| Example 4 | Copolymer-4 | D | 10 wt. parts | a | 90 wt. parts | 36000 | 6900 |
| Example 5 | Copolymer-5 | B | 40 wt. parts | a | 60 wt. parts | 35000 | 7500 |
| Example 6 | Copolymer-6 | C | 50 wt. parts | a | 50 wt. parts | 42000 | 8200 |
| Example 7 | Copolymer-7 | A | 30 wt. parts | c | 70 wt. parts | 29900 | 6500 |
| Example 8 | Copolymer-8 | C | 40 wt. parts | e | 60 wt. parts | 29600 | 6200 |
| Example 9 | Copolymer-9 | D | 30 wt. parts | f | 70 wt. parts | 36500 | 7000 |
| Example 10 | Copolymer-10 | D | 40 wt. parts | a | 60 wt. parts | 35000 | 6900 |
| Comparative Example 1 | Copolymer-11 | E | 30 wt. parts | a | 70 wt. parts | 32300 | 6300 |
| Comparative Example 2 | Copolymer-12 | A | 30 wt. parts | d | 70 wt. parts | 29100 | 5900 |
| Comparative Example 3 | Copolymer-13 | F | 30 wt. parts | a | 70 wt. parts | 39800 | 8300 |
| Comparative Example 4 | Copolymer-14 | C | 0.5 wt. parts | a | 99.5 wt. parts | 42700 | 8400 |
| Comparative | Copolymer-15 | A | 70 wt. parts | a | 30 wt. parts | 36600 | 7300 |

TABLE 3-continued

| Copolymer | Crystalline polymer and its weight part ratio | Amorphous polymer and its weight part ratio | Weight average molecular weight Mw | Number average molecular weight Mn |
|---|---|---|---|---|
| Example 5 | | | | |

Next, 3 parts of the toner 1 and 97 parts of a carrier coated with a styrene-methyl methacrylate copolymer resin having an average particle size of 100 μm were mixed to prepare a developer. By use of this developer, real copying test was conducted, wherein formation of an electrostatic image and development thereof were carried out by means of an electrophotographic copying machine "U-Bix 1600" (produced by Konishiroku Photo Industry Co.), the toner image obtained was transferred onto a transfer paper and the transferred image was fixed by a heated roller fixer to form a copied image. The lowest fixing temperature (the lowest temperature of the heating roller at which fixing is possible), the off-set generation temperature (the lowest temperature at which off-set phenomenon occurs) were measured, and also the fixable range was determined.

The lowest fixing temperature:

After formation of an unfixed image by the above copying machine, by means of a fixer comprising a hot roller of 30 ϕ having a surface layer formed of Teflon (polytetrafluoroethylene produced by Du Pont Co.) and pressure roller having a surface layer formed of a silicone rubber "KE-1300RTV" (produced by Shinetsu Kagaku Kogyo Co.), the operation of fixing the toner image with a sample toner transferred onto a transfer paper of 64 g/m$^2$ at a line speed of 70 mm/sec, a line pressure of 0.8 kg/cm and a nip width of 4.9 mm was repeated at the respective temperatures of the hot roller elevated stepwise by 5° C. within the set temperature range of from 80° to 240° C., and Kimwipe scraping was applied on the fixed image formed. The lowest set temperature capable of giving a fixed image exhibiting sufficient scraping resistance is defined as the lowest fixing temperature. The fixer used here has no silicone oil feeding mechanism.

Off-set generation temperature:

Measurement of off-set generation temperature is similar to measurement of the lowest fixing temperature. After formation of an unfixed image by the above copying machine, the operation of transferring the toner image and carrying out fixing treatment by the fixer as described above, and subsequently delivering a white transfer paper to the fixer under the same conditions for observation with eyes whether toner staining occurs thereon or not is repeated under the state where the set temperature of the hot roller of the above fixer is successively elevated. The lowest set temperature at which staining with the toner occurred is defined as the off-set generation temperature.

Fixable range:

The difference between the off-set generation temperature and the lowest fixing temperature is defined as the fixable range.

The results are shown in Table 4.

Further, blocking characteristic, pulverization efficiency, filming characteristic, cleaning characteristic and charged quantity (Q/M) of the toner 1 and flowability of the developer prepared by use of the above toner were measured as follows.

Anti-blocking property:

Anti-blocking property test was examined by whether an agglomerated mass was formed or not when the toner was left to stand under the environmental conditions of 45° C. and 43% RH for 2 hours.

Pulverization efficiency:

Judged by the feed quantity when finely pulverized by a ultra-sonic jet mill under the condition of a pressure of 5.4 kg/cm$^2$.

Filming characteristic:

Filming characteristic was judged by presence or absence of attached matter when the carrier and the surface of the photosensitive member were observed.

Cleaning characteristics:

Cleaning characteristic was judged by presence or absence of attached matter when the surface of the photosensitive member after cleaned with a cleaning member was observed.

Flowability of developer:

Flowability of developer was judged by visual observation of the developer in a developing instrument, and one at a practical level was rated as good.

Charged quantity (Q/M):

The charged quantity is the value of triboelectric charges per 1 g of toner measured according to the known blow off method.

The results are shown also in Table 4.

Further, for the images obtained by use of the toner 1, fog, the maximum image density ($D_{max}$), and sharpness were measured and evaluated as follows.

Fog:

Fog is shown by the relative density to the developed image at the white ground portion with manuscript density of 0.0 (white ground reflective density is defined as 0.0).

O less than 0.01

Δ 0.01 - less than 0.03 x 0.03 or higher

Maximum image density ($D_{max}$):

This is shown by the relative density of the developed image when the image density of the original picture is made 1.3. Measurement was performed by Sakura densitometer (produced by Konishiroku Photo Industry Co.).

Sharpness:

With the line picture chart of the manuscript as original, its reproducibility is enlarged and judged visually.

The results obtained are shown also in Table 4.

Further, durability test was conducted by use of the toner 1. That is, after the developing process was repeated for 30,000 times, charged quantity Q/M, the change in charged quantity Δ Q/M of the toner, flowability, filming characteristic and cleaning characteristic of the developer, and fog, the maximum image density ($D_{max}$), sharpness of the image obtained were measured and evaluated similarly as described above. The results are shown in Table 5.

TABLE 4

| | A | B | C | D | E | F | G | H | I | J | K | L | M | N |
|---|---|---|---|---|---|---|---|---|---|---|---|---|---|---|
| Example 1 | Toner 1 | 110 | 240 | 130 | | Very good | −21.4 | Very good | | 1.33 | Good | $1.2 \times 10^4$ | $2.2 \times 10^4$ | 110 |
| Example 2 | Toner 2 | 110 | 240 | 130 | | Very good | −21.2 | Very good | | 1.35 | Good | $1.3 \times 10^4$ | $2.5 \times 10^4$ | 140 |
| Example 3 | Toner 3 | 115 | 240 | 125 | | Very good | −20.8 | Very good | | 1.34 | Good | $1.4 \times 10^4$ | $4.1 \times 10^4$ | 130 |
| Example 4 | Toner 4 | 110 | 240 | 130 | | Very good | +12.1 | Very good | | 1.35 | Good | $1.5 \times 10^4$ | $2.6 \times 10^4$ | 140 |
| Example 5 | Toner 5 | 110 | 210 | 100 | | Very good | −20.5 | Very good | | 1.31 | Good | $1.1 \times 10^4$ | $2.2 \times 10^4$ | 100 |
| Example 6 | Toner 6 | 105 | 200 | 95 | | Very good | 19.8 | Very good | | 1.30 | Good | $8.0 \times 10^3$ | $1.6 \times 10^4$ | 100 |
| Example 7 | Toner 7 | 110 | 190 | 80 | Δ | Slightly bad | −18.2 | Slightly bad | Δ | 1.30 | Slightly bad | $9.5 \times 10^3$ | $3.4 \times 10^4$ | 110 |
| Example 8 | Toner 8 | 115 | 190 | 75 | Δ | Slightly bad | −18.3 | Slightly bad | Δ | 1.29 | Slightly bad | $1.4 \times 10^4$ | $4.2 \times 10^4$ | 110 |
| Example 9 | Toner 9 | 110 | 200 | 90 | Δ | Slightly bad | −17.9 | Slightly bad | Δ | 1.30 | Slightly bad | $3.4 \times 10^4$ | $3.4 \times 10^4$ | 110 |
| Example 10 | Toner 10 | 110 | 185 | 75 | Δ | Slightly bad | −18.4 | Slightly bad | Δ | 1.31 | Slightly bad | $3.3 \times 10^4$ | $3.3 \times 10^4$ | 110 |
| Com. Ex. 1 | Com. toner 1 | 110 | 140 | 30 | X | Bad | 11.8 | Slightly bad | X | 0.71 | Bad | $1.0 \times 10^3$ | $2.3 \times 10^3$ | 100 |
| Com. Ex. 2 | Com. toner 2 | 110 | 120 | 10 | X | Bad | 11.5 | Bad | X | 0.77 | Bad | $8.6 \times 10^2$ | $9.8 \times 10^2$ | 70 |
| Com. Ex. 3 | Com. toner 3 | 210 | 240 | 30 | | Very good | −19.8 | Slightly bad | | 1.33 | Good | $2.1 \times 10^6$ | $5.4 \times 10^6$ | 140 |
| Com. Ex. 4 | Com. toner 4 | 200 | 240 | 40 | | Very good | 20.6 | Very good | | 1.31 | Good | $1.5 \times 10^6$ | $3.7 \times 10^6$ | 140 |
| Com. Ex. 5 | Com. toner 5 | 120 | 120 | 0 | Δ | Bad | 11.0 | Bad | X | 0.62 | Slightly bad | $2.3 \times 10^2$ | $8.8 \times 10^2$ | 70 |

Note for Table 4
A: Toner
B: Minimum fixing temperature °C.
C: Off-set generation temperature °C.
D: Fixable range °C.
E: Anti-blocking property
F: Flowability of developer
G: Charged quantity Q/M μc/g
H: Pulverization efficiency
I: Fog
J: Maximum image density $D_{max}$
K: Sharpness
L: Dynamic modulus G dyn/cm$^2$
M: Dynamic viscosity η poise
N: Measurement temperature for G', η'

TABLE 5

| | Toner | Charged quantity Q/M μc/g | Change in charged quantity μc/g | Filming characteristic | Cleaning characteristic | Flowability of developer | Fog | Maximum image density | Sharpness |
|---|---|---|---|---|---|---|---|---|---|
| Ex. 1 | Toner 1 | −20.5 | 0.9 | None | Very good | Very good | | 1.28 | Good |
| Ex. 2 | Toner 2 | −20.3 | 0.9 | None | Very good | Very good | | 1.30 | Good |
| Ex. 3 | Toner 3 | −20.1 | 0.7 | None | Very good | Very good | | 1.30 | Good |
| Ex. 4 | Toner 4 | +11.6 | 0.5 | None | Very good | Very good | | 1.31 | Good |
| Ex. 5 | Toner 5 | −19.1 | 1.4 | None | Very good | Very good | | 1.27 | Good |
| Ex. 6 | Toner 6 | −18.6 | 1.2 | None | Very good | Very good | | 1.25 | Good |
| Ex. 7 | Toner 7 | −14.5 | 3.7 | Slightly " | Slightly bad | Slightly bad | Δ | 1.07 | Slightly bad |
| Ex. 8 | Toner 8 | −14.7 | 3.6 | Slightly " | Slightly bad | Slightly bad | Δ | 1.10 | Slightly bad |
| Ex. 9 | Toner 9 | −14.2 | 3.7 | Slightly " | Slightly bad | Slightly bad | Δ | 1.05 | Slightly bad |
| Ex. 10 | Toner 10 | −15.0 | 3.4 | Slightly "bad | Slightly bad | Slightly | Δ | 1.08 bad | Slightly |
| Com. ex. 1 | Comparative toner 1 | −2.6 | 9.2 | Much | Bad | Bad | X | 0.42 | Unclear |
| Com. ex. 2 | Comparative toner 2 | −2.3 | 9.2 | Much | Bad | Bad | X | 0.41 | Unclear |
| Com. ex. 3 | Comparative toner 3 | −25.3 | 5.5 | None | Very good | Very good | Δ | 0.78 | Slightly unclear |
| Com. ex. 4 | Comparative toner 4 | −23.8 | 3.2 | None | Very good | Very good | | 0.97 | Slightly unclear |
| Com. ex. 5 | Comparative | −1.3 | 9.9 | Much | Slightly bad | Slightly bad | X | 0.40 | Unclear |

TABLE 5-continued

| Toner | Charged quantity Q/M μc/g | Change in charged quantity μc/g | Filming charac-teristic | Cleaning charac-teristic | Flow-ability of developer | Fog | Maximum image density | Sharpness |
|---|---|---|---|---|---|---|---|---|
| toner 5 | | | | | | | | |

Examples 2–3

Copolymers 2 and 3 were prepared respectively in the same manner as in Example 1 except for using the crystalline polymer and the amorphous polymers at prescribed weight part ratios shown in Table 3, and further toners 2 and 3 were obtained. The respective physical property values and performances of the toners 2 and 3 obtained were measured similarly as in Example 1.

Real copying test was conducted similarly as in Example 1 by use of the toners 2 and 3 to measure and evaluate the respective performances.

Example 4

A copolymer 4 was obtained in the same manner as in Example 1 except for using the crystalline polymer and the amorphous polymer at a prescribed weight part ratio shown in Table 3.

In the same manner as in Example 1 except for using 100 parts by weight of the copolymer 4, 60 parts by weight of a magnetic material "BL-500" (produced by Titan Kogyo Co.), 3 parts by weight of a polypropylene "Piscol-660P" (produced by Sanyo Kasei Kogyo Co.) and 1.5 parts by weight of a charge controller "Nigrosine S.O." (produced by Orient Kagaku Co.), a toner 4 which is one-component magnetic toner was obtained. The respective physical property values and performances of the toner 4 obtained were measured similarly as in Example 1.

Real copying test was conducted by means of an electrophotographic copying machine "U-Bix 1200" (produced by Konishiroku Photo Industry Co.) by use of the toner 4, and the respective performances were measured and evaluated similarly as in Example 1.

Examples 5–10

Copolymers 5–10 were respectively prepared in the same manner as in Example 1 except that the crystalline polymer and the amorphous polymers at prescribed weight ratios shown in Table 3 were employed, and further toners 5–10 were obtained. The respective physical property values and performances of the toners obtained were measured similarly as in Example 1. By use of toners 5–10, real copying test was conducted similarly as in Example 1 to measure and evaluate the respective performances.

Comparative example 1

A copolymer 11 was obtained in the same manner as in Example 1 except for using 30 parts by weight of the crystalline polymer E and 70 parts by weight of the amorphous polymer a.

A comparative toner 1 was obtained in the same manner as in Example 1 except for using 100 parts by weight of the copolymer 11, 10 parts by weight of a carbon black "Mogal-L" and 3 parts by weight of the charge controller. The physical property values and performances of the comparative toner 1 obtained were measured similarly as in Example 1.

By use of the comparative toner 1, real copying test was conducted similarly as in Example 1 to measure and evaluate the respective performances.

Comparative examples 2–5

Copolymers 12–15 were obtained in the same manner as in Comparative example 1 except for using the crystalline polymers and the amorphous polymers at prescribed weight part ratios shown in Table 3, and further comparative toners 2–5 were obtained. The physical property values and performances of the comparative toners 2–5 obtained were measured similarly as in Example 1.

By use of the comparative toners 2–5, real copying test was conducted similarly as in Comparative example 1 to measure and evaluate the respective performances.

The measurement results obtained Example 2–10 and Comparative example 1–5 are shown respectively in Table 4 and Table 5.

As is apparent from Table 4 and Table 5, all of the toners according to the present invention exhibit good results for respective performances. In contrast, in comparative toners 1, 2, 5, dynamic moduli are too low and therefore bad in off-set resistance with the fixable range being narrow, and also bad in anti-blocking characteristic, generating filming in durability test and causing cleaning characteristic badness.

Also, flowability and charging characteristic of the developer prepared by use of this toner were bad, and there could be obtained only images by use thereof which are much in fog, low in developed density and unclear. In the durability test, the charged quantity was greatly lowered to give only unclear images with much fog and low image density. Thus, the toner was inferior in durability. Further, in Comparative examples 3, 4, the dynamic viscosity $\eta'$ was too great and therefore fixing characteristic was bad, and also elevation of charged quantity and generation of fog were recognized in durability test to give unclear images.

Utilizability in industry

The toner of the present invention uses a resin constituted mainly of a copolymer comprising a crystalline polymer block and an amorphous polymer block chemically bound together, the crystalline polymer block has a specific melting point, the amorphous polymer block has a specific glass transition point and the dynamic moduli of the toner have a value within a specific range. Therefore, according to the toner of the present invention, it is possible to provide a toner excellent in durability, which is capable of sufficiently fixing even at a low temperature and yet good in off-set resistance within such a temperature range, having further excellent anti-blocking characteristic, flowability, charging characteristic, anti-filming characteristic, cleaning characteristic, thereby enabling formation of good, stable visible images.

What is claimed is:

1. In a toner for development of electrostatic images using hot roller development of the type comprising a resin and a colorant, the improvement comprising said resin being mainly constituted of a copolymer comprising a crystalline polymer block and an amorphous polymer block chemically bound to each other and wherein said crystalline polymer block has a melting point of 50° to 120° C.; has a number average molecular weight of 1,000 to 20,000; has a weight average molecular weight of 2,000 to 100,000; comprises a crystalline polyalkylene polyester; and is contained in said copolymer in an amount of 5 to 50 parts by weight based on 100 parts by weight of said copolymer;

said amorphous polymer block has a glass transition point of 50° to 100° C.; has a number average molecular weight of 1,000 to 50,000; and comprises an amorphous aromatic polyester;

said copolymer has a number average molecular weight of 1,000 to 30,000; has a weight average molecular weight of 5,000 to 300,000; and has a dynamic moduli of $2\times10^3$ to $1\times10^5$ dye/cm$^2$ at least one point from 70° to 140° C.; and said toner further comprising an inorganic fine powder in an amount of 0.01 to 5% by weight based on the total weight of the toner.

2. The toner for development of electrostatic images according to claim 1, wherein said amorphous polymer block has a glass transition point of 50° to 85° C.

3. The toner of claim 1 wherein the difference in solubility parameters between said crystalline polymer block and said amorphous polymer block is at least 0.9 as determined by the method of Fedors.

4. The toner of claim 1 further comprising carrier particles and said resin and colorant forming toner particles whereby said toner is a two component toner comprising toner particles and carrier particles.

5. The toner of claim 1 wherein said toner is a one component toner.

6. The toner for development of electrostatic images according to claim 1, wherein said polyalkylene polyester polymer is polyethylene sebacate, polyethylene adipate, polyethylene suberate, polyethylene succinate, polyethylene-p-(carbophenoxy)undecaate, polyhexamethylene oxalate, polyhexamethylene sebacate, polyhexamethylene decanedioate, polyoctamethylene dodecanedioate, polynonamethylene azelate, polydecamethylene adipate, polydecamethylene azelate, polydecamethylene oxalate, polydecamethylene sebacate, polydecamethylene succinate, polydecamethylene dodecadioate, polydecamethylene octadecanedioate, polytetramethylene sebacate, polytrimethylene dodecanedioate, polytrimethylene octadecanedioate, polytrimethylene oxalate, polyhexamethylene-decamethylene-sebacate, or polyoxydecamethylene-2-methyl-1,3-propane-dodecanedioate, 7. An image forming method according to claim 6, wherein said amorphous polymer block has a glass transition point of 50° to 85° C.

8. The toner of claim 1 wherein the inorganic fine powder has a primary particle size of 5 μm to 2 μm.

9. The toner of claim 8 wherein said particle size is 5 μm to 500 μm.

10. The toner of claim 8 wherein the surface area of said powder is 20 to 500 m$^2$/g according to the BET method.

11. The toner of claim 10 wherein the inorganic fine powder is fine powder of silica, alumina, titanium oxide, barium titanate, magnesium titanate, calcium titanate, strontium titanate, zinc oxide, silicious sand, clay, mica, wollastonite, diatomaceous earth, chromium oxide, cerium oxide, lead iron oxide, antimony trioxide, magnesium oxide, zirconium oxide, barium sulfate, barium carbonate, calcium carbonate, silicon carbide or silicon nitride.

12. The toner of claim 11 wherein the fine powder is silica.

13. In a toner for development of electrostatic images using hot roller development, of the type comprising a resin and a colorant forming toner particles, the improvement comprising said resin being mainly constituted of a copolymer comprising a crystalline polymer block and an amorphous polymer block chemically bound to each other wherein said crystalline polymer block has a melting point of 50° to 120° C.; has a number average molecular weight of 1,000 to 20,000; has a weight average molecular weight of 2,000 to 100,000; comprises a crystalline polyalkylene polyester; and is contained in said copolymer in an amount of 5 to 50 parts by weight based on 100 parts by weight of said copolymer;

said amorphous polymer block has a glass transition point of 50° to 100° C.; has a number average molecular weight of 1,000 to 50,000; and comprises an amorphous aromatic polyester;

the difference in solubility parameters between said crystalline polymer block and said amorphous polymer block being at least 0.9 as determined by the method of Fedors;

said copolymer has a number average molecular weight of 1,000 to 30,000; has a weight average molecular weight of 5,000 to 300,000; and has a dynamic moduli of $2\times10^3$ to $1\times10^5$ dye/cm$^2$ at least one point from 70° to 140° C.;

an inorganic fine powder in an amount of 0.01 to 5% by weight based on the total weight of the toner; and carrier particles in an amount of 3 parts toner particles to 1 to 97 parts carrier particles.

14. The image forming method according to claim 13 wherein said polyalkylene polyester polymer is polyethylene sebacate, polyethylene adipate, polyethylene suberate, polyethylene succinate, polyethylene-p-(carbophenoxy)undecaate, polyhexamethylene oxalate, polyhexamethylene sebacate, polyhexamethylene decanedioate, polyoctamethylene dodecanedioate, polynonamethylene azelate, polydecamethylene adipate, polydecamethylene azelate, polydecamethylene oxalate, polydecamethylene sebacate, polydecamethylene succinate, polydecamethylene dodecadioate, polydecamethylene octadecanedioate, polytetramethylene sebacate, polytrimethylene dodecanedioate, polytrimethylene octadecanedioate, polytrimethylene oxalate, polyhexamethylene-decamethylene-sebacate, or polyoxydecamethylene-2-methyl-1,3-propane-dodecanedioate.

15. A toner for development of electrostatic images according to claim 13, wherein said amorphous polymer block has a glass transition point of 50° to 85° C.

16. An image forming method, which comprises developing with a toner for development of electrostatic images on a photosensitive member constituted of at least a resin and a colorant, wherein said resin is mainly constituted of a copolymer comprising a crystalline polymer block and an amorphous polymer block chemically bound to each other, said crystalline polymer block has a melting point of 50° to 120° C., said amorphous polymer block has a glass transition point of 50° to 100° C., and at least one point of the dynamic moduli at 70° to 140° C. of said toner has a value not smaller than $2\times10^3$ dyn/cm$^2$ and not greater than $1\times10^5$ dyn/cm$^2$, effecting electrostatic transfer onto a transfer material such as paper, etc., and carrying out hot roller fixing to obtain a fixed image.

17. The image forming method according to claim 16, wherein 1 to 60 parts by weight of said crystalline polymer block is contained in said copolymer base on 100 parts by weight of said copolymer.

18. The image forming method according to claim 16, wherein said amorphous polymer block has a glass transition point of 50° to 85° C.

19. The image forming method according to claim 16, wherein said crystalline polymer block is constituted of a polyester polymer.

* * * * *

UNITED STATES PATENT AND TRADEMARK OFFICE

CERTIFICATE OF CORRECTION

PATENT NO. : 4,940,644

DATED : July 10, 1990

INVENTOR(S) : MATSUBARA et al

It is certified that error appears in the above-identified patent and that said Letters Patent is hereby corrected as shown below:

Title Page:

Under Section "[75] Inventors": After "Yoshio Takizawa" insert --Hiroyuki Takagiwa; Hiroyuki Nomori, all of Tokyo, Japan--; and delete "all of Hachioji, Japan".

Under Section "[56] References Cited, U.S. PATENT DOCUMENTS": insert --3,937,637 2/1976 Moser et al ... 430/99--.

Signed and Sealed this

Twenty-eighth Day of July, 1992

*Attest:*

DOUGLAS B. COMER

*Attesting Officer*

*Acting Commissioner of Patents and Trademarks*